US005892447A

United States Patent [19]

Wilkinson

[11] Patent Number: 5,892,447

[45] Date of Patent: Apr. 6, 1999

[54] PORTABLE CELLULAR ALERT SYSTEM

[76] Inventor: Milton E. Wilkinson, P.O. Box 470, Palmer Lake, Colo. 80133

[21] Appl. No.: 761,486

[22] Filed: Dec. 6, 1996

[51] Int. Cl.[6] ..... G08B 23/00

[52] U.S. Cl. ..... 340/573.4; 340/407.1; 379/37; 455/67.7; 455/351; 455/566; 455/575

[58] Field of Search ..... 340/573.4, 574, 340/539, 541, 825.49, 514, 309.15, 691, 407.1; 379/37, 38, 45, 51; 455/67.7, 67.1, 566, 575, 100, 351; 342/118

[56] References Cited

U.S. PATENT DOCUMENTS 3,478,344 11/1969 Schwitzgebel et al. ..... 340/539 X
4,785,291 11/1988 Hawthorne ..... 340/573
5,218,344 6/1993 Ricketts ..... 340/573
5,283,546 2/1994 Scop et al. ..... 379/45 X
5,289,163 2/1994 Perez et al. ..... 340/573 X
5,396,227 3/1995 Carroll et al. ..... 340/573 X
5,557,259 9/1996 Musa ..... 340/573
5,587,701 12/1996 Hess ..... 340/541

*Primary Examiner*—Thomas Mullen
*Attorney, Agent, or Firm*—Duft, Graziano & Forest, P.C.

[57] ABSTRACT

The claimed invention comprises a personal warning system including a mobile transmitting device and a mobile receiving device including a receiver which receives signals transmitted by the transmitting device, a proximity device for providing a signal indicative of the proximity of the transmitting device and an alarm, communicating with the proximity device, for providing warning of the proximity of the transmitting device.

15 Claims, 7 Drawing Sheets

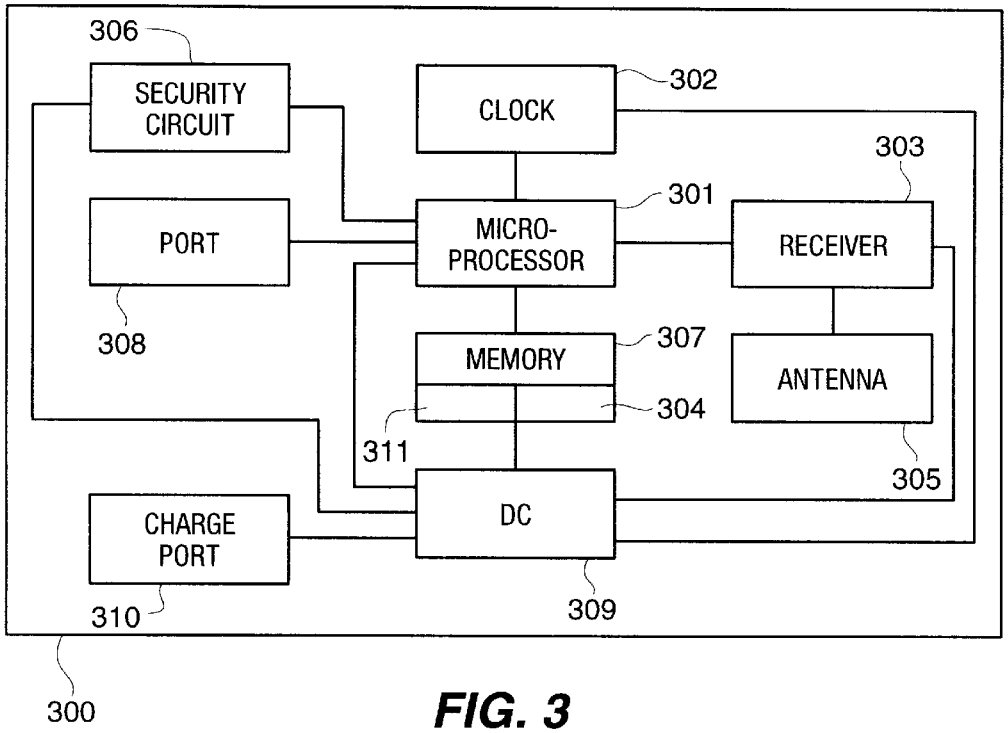
FIG. 3
FIG. 10
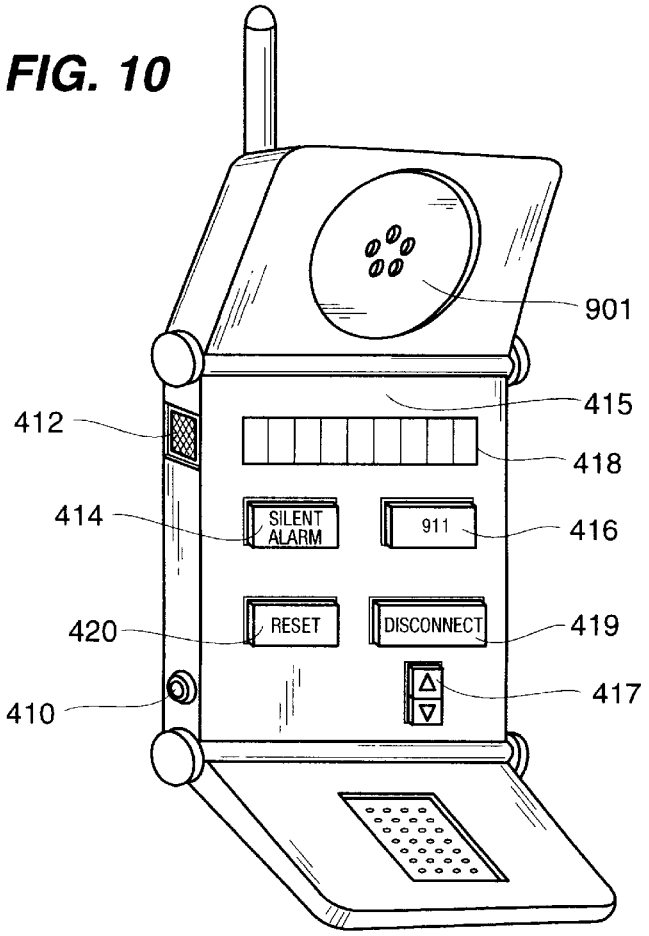

PORTABLE CELLULAR ALERT SYSTEM

BACKGROUND OF THE INVENTION

1. Field of the Invention

The invention relates to an apparatus that warns a person of the proximity of another person and provides a means for contacting police or emergency services in the event that the proximity of the person is detected.

2. Statement of the Problem

More than ever in today's society there is an increasing need to provide secure perimeters around objects or persons that either require protection or pose a threat to others. Hazardous materials, such as toxic chemicals or radioactive materials, must be kept at a safe distance from people to prevent direct or indirect contact that causes injury or death. Weapons caches, classified projects and secure areas must also remain free from authorized access to maintain the integrity of national security or industrial secrets. Secure perimeters are necessary to provide sterile environments required by laboratories, the medical industry and electronics assembly plants. Similarly, the extremely high level of security in facilities that store large amounts of cash, jewels, or precious metals require boundaries that provide absolute protection for restricted areas.

In addition to keeping objects and materials safe, there is often a requirement to prevent contact between human beings. Dramatic increases in the number of domestic violence cases have resulted in record numbers of restraining orders issued by courts, enforced only by the threat of incarceration. Overcrowded jails and prisons have left local governments no practical alternative other than house arrest for all but the most dangerous offenders. Likewise, mental institutions constantly grapple with security issues, expending enormous amounts of resources to confine patients and search for and apprehend those who inevitably escape.

Current attempts to solve these problems have been costly, inefficient, time consuming, and have required enormous manpower. The number of prison guards employed by the average prison constitutes a small army, as do the security forces for most mental institutions. Defense plants spend millions of dollars annually for elaborate surveillance systems, using closed-circuit tv cameras, motion detectors, palm scans, and retina scans to monitor their employees. Costly background checks of employees, regardless of their involvement in secret projects, are conducted simply because an employee's work area might be within the same building or complex as a secret project. Similar resources are expended to protect the nation's mints and gold reserve, where employees must be monitored as carefully as outsiders.

The problem is more complex when the object or person around which a secure perimeter must be maintained is mobile. Transporting hazardous materials and precious cargos makes safety extremely difficult, as secure facilities that warehouse such items cannot be moved. The secure perimeter simply cannot be maintained when the only route available to transport the cargo is through a densely populated area. Transporting prisoners and mental patients between detention facilities provides an increased chance of escape, and complying with a restraining order is difficult when both parties are free to move around the same small town or neighborhood. The inherent mobility of human beings has made it impossible to develop a reliable method to monitor the location of the escaped prisoner or mental patient, or to warn the person protected by restraining order when the subject of the restraining order is near. While the ankle bracelet used to monitor people under house arrest verifies a prisoner's presence within a bounded area, this device fails to verify the location of the prisoner once he or she has left the boundaries of the restricted area.

There is a dire need for a portable device that will provide warning to a potential victim of a threatening person's proximity. In addition to such warning, a means for immediately summoning help is required to prevent harm.

SUMMARY OF THE INVENTION

The claimed invention solves these problems and achieves an advance in the art by use of a transmitter and receiver that provides warning to a potential victim of the proximity of a threatening person. While the claimed invention is not perfect and cannot provide a failsafe system, it represents a significant advance in the art. The apparatus comprises three separate components: a transmitting device that signals the location of the threatening person, a monitoring device that records any service interruption of the transmitting device, and a receiving device that warns the potential victim of the threatening person's proximity. The transmitting device transmits an electromagnetic signal at regular intervals and at a set frequency. The receiving device monitors this frequency and sounds an alarm if the transmitter's signal is detected. Signal strength of the signal emitted by the transmitting device is used to trigger the warning alarm in the receiving device. The transmitting device transmits a very weak signal, detectable by the receiving device only when the transmitting device is within 1000 to 500 feet of the receiving device.

The claimed invention solves the portability problem by powering the transmitting device, monitoring device and receiving device by battery. The transmitting device is secured to its host by a plastic bracelet or similar means, preferably around the wrist or ankle. An electrical current is passed through a wire woven into the bracelet that secures the device to the threatening person. In the event that the host attempts to remove the device by severing the bracelet this circuit will be broken and the transmitting device will record the date and time that the host tampered with the transmitting device. The battery that powers the transmitting device cannot be removed by its host and may be changed or recharged by authorized service personnel only.

The host also wears a monitoring device, a second device located on a wrist or ankle that does not bear the transmitting device. This device is attached to the host by the same means as the transmitting device, and also incorporates a wire around the wrist or ankle to determine if the host tampers with the device. The purpose of this device is to monitor the transmission of signals by the transmitting device, and record any periods where transmission service is interrupted, i.e. where the host has blocked transmission by covering the device with tin foil or an RF absorbent material.

The potential victim carries the receiving device. The receiving device is powered by a nonremovable battery system which allows the receiving device to constantly monitor the predetermined frequency even while charging. Once the receiving device has detected the signal emitted by the transmitting device, the signal amplitude analyzer analyzes the strength of the signal, and if the signal is of sufficient strength an alarm is sounded. The potential victim has the option to select a silent alarm mode, which notifies the potential victim of the proximity of the transmitting device by causing the receiving device to vibrate and the LED display of the receiving device to flash the date and time the alarm was received. A reset button located on the receiving device cancels the alarm until the proximity of the transmitting device is again detected.

A cellular phone built into the receiving device is activated once the alarm is sounded, allowing the user to contact the police or dial 911. Telephone numbers for the police department or 911 can be pre-programmed into the cellular telephone and may be dialed by pressing a single button. A volume control is also located on the unit to adjust the volume of the telephone speaker and the alarm speaker. A disconnect button is also located on the receiving device to terminate the telephone connection.

The invention provides a personal warning system comprising:

a mobile transmitting device for transmitting electromagnetic signals and a mobile receiving device comprising: a receiver for receiving electromagnetic signals transmitted by the transmitting device; a proximity device for providing a signal indicative of the proximity of the transmitting device; and an alarm, communicating with the proximity device, for providing a warning of the proximity of the transmitting device. Preferably, the proximity device includes an electromagnetic signal amplitude monitor. Preferably, the receiving device includes a cellular telephone for communicating with police or emergency personnel. Preferably, the receiving device further includes a switch that automatically activates a cellular telephone upon receipt of said signal from said proximity device. Preferably, the receiving device further includes an audible alarm and a vibrating alarm. Preferably, the receiving device further includes a switch to select the audible alarm or the vibrating alarm. Preferably, the receiving device further includes a reset switch to terminate the alarm until proximity of the transmitting device is detected again. Preferably, the receiving device further comprises a battery charger for charging the battery of the receiving device while the receiving device continues to monitor electromagnetic signals transmitted by the transmitting device.

The invention also provides a transmission monitoring device for verifying transmission of signals by the transmitting device.

The invention also provides a bracelet to attach a selection from the group consisting of the transmitting device and the transmission monitoring device to the limb of a human being. Preferably, the bracelet comprises: a wire embedded in the bracelet that attaches the selection to the limb; electrical connections for generating an electrical current along the wire; and a recorder for recording the date and time the wire is severed.

In an alternative embodiment, the invention provides a personal warning system comprising: a transmitting device for transmitting electromagnetic signals; a receiving device comprising: a receiver for receiving the electromagnetic signals transmitted by the transmitting device; a proximity device for providing a signal indicative of the proximity of the transmitting device; and a cellular telephone for communicating with police or emergency personnel. Preferably, the cellular telephone of the receiving device includes an automatic dialer for dialing a preprogrammed telephone number. Preferably, the cellular telephone of the receiving device further includes a speaker volume control.

This embodiment of the invention also provides a transmission monitoring device for verifying transmission of signals by the transmitting device.

This embodiment of the invention also provides a bracelet to attach a selection from the group consisting of the transmitting device and the transmission monitoring device to the limb of a human being. Preferably, the bracelet comprises: a wire embedded in the bracelet that attaches the selection to the limb; electrical connections for generating an electrical current along the wire; and a recorder for recording the date and time the wire is severed.

In another aspect, the invention provides a monitoring system comprising:

a transmitter to transmit an electromagnetic signal at a set frequency and over periodic intervals; a bracelet to attach the transmitting device to the limb of a human being; a receiving device for receiving signals transmitted by the transmitting device; a bracelet to attach the receiving device to the limb of a human being; and a recorder for recording the date and time the receiving device does not receive the electromagnetic signal transmitted by transmitter. Preferably, the transmitting system includes a verification system comprising: a wire embedded in the bracelet that attaches the transmitter to the limb; electrical connections for generating an electrical current along the wire; and a recorder for recording the date and time the wire is severed. Preferably, the receiving device includes a verification system comprising: a wire embedded in the bracelet that attaches the receiver to the limb; electrical connections for generating an electrical current along the wire; and a recorder for recording the date and time the wire is severed.

BRIEF DESCRIPTION OF THE DRAWING

FIG. 3 shows a block diagram of the monitoring system according to the invention;

FIG. 10 illustrates the preferred embodiment of the receiving system.

DETAILED DESCRIPTION OF THE PREFERRED EMBODIMENT

Figure 1:
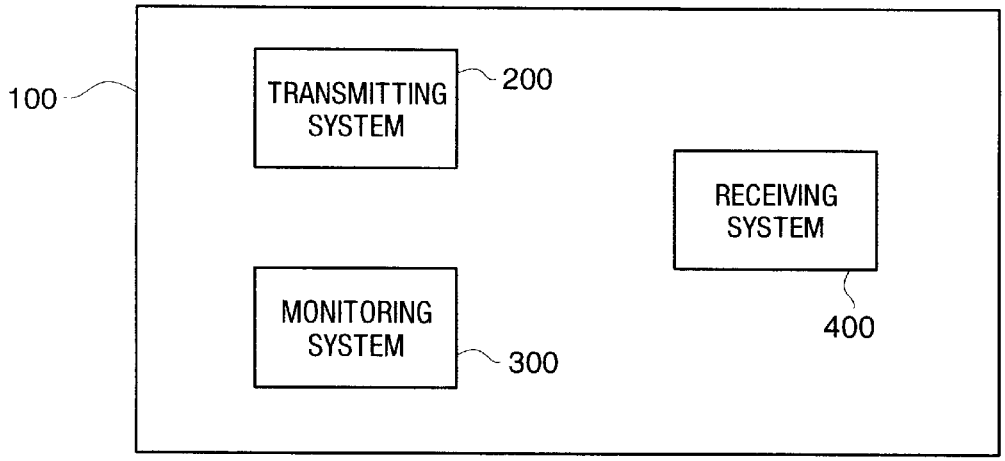
FIG. 1 shows a block diagram of the portable cellular alert system apparatus according to the invention.

A block diagram of the preferred embodiment of a portable cellular alert system apparatus 100 according to the invention is shown in FIG. 1. The apparatus includes a transmitting system 200, a monitoring system 300, and a receiving system 400. Transmitting system 200 and monitoring system 300 are attached to a person whose proximity to another person is monitored. Receiving system 400 is carried by the person who monitors the proximity of the person wearing transmitting system 200 and monitoring system 300. Transmitting system 200, attached to a limb of the person whose proximity to the person carrying receiving system 400 is monitored, emits an electromagnetic signal at regular intervals. Monitoring system 300 and receiving system 400 monitor the signal transmitted by transmitting system 200. Monitoring system 300 continuously receives the signal transmitted by transmitting system 200 and records the date and time if there is any interruption of signal reception. Receiving system 400 continuously monitors the signal transmitted by transmitting system 200, but records the date and time and provides a warning only when the strength of the signal transmitted by transmitting system 200 is above a predetermined threshold.

Figure 2:
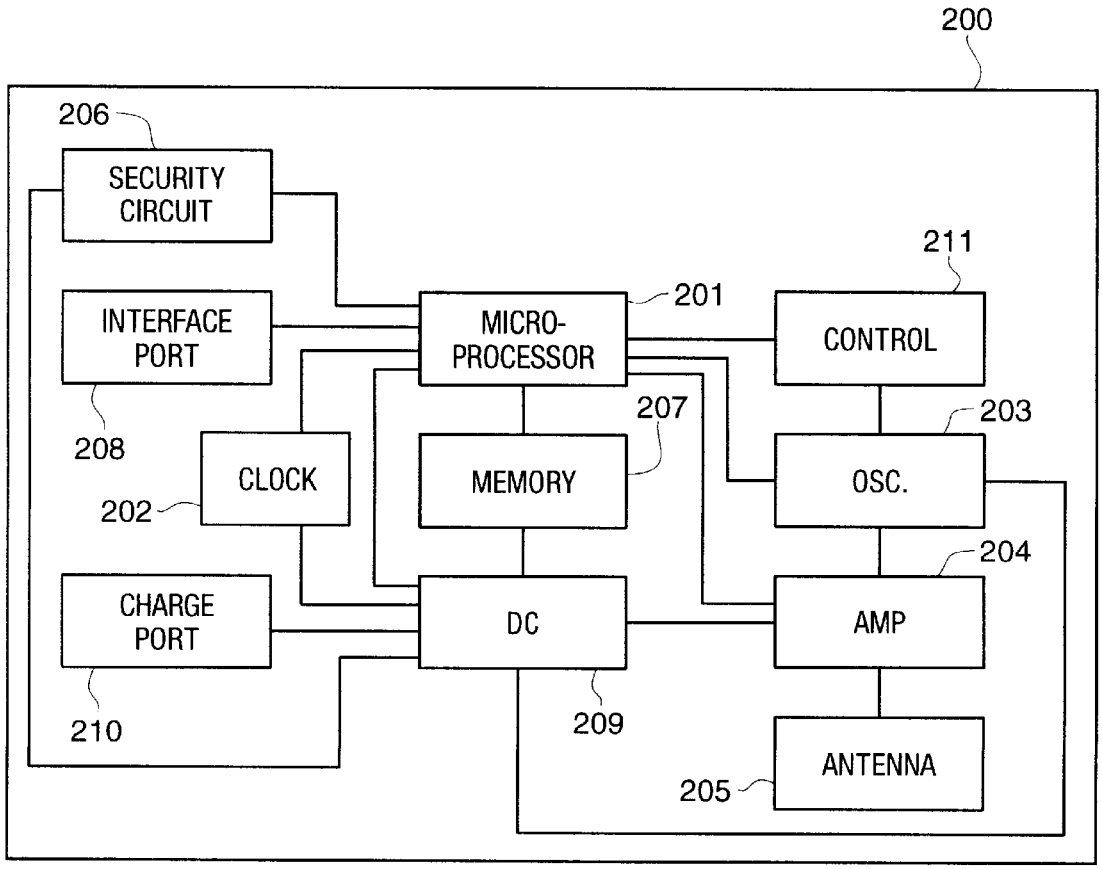
FIG. 2 shows a block diagram of the transmitting system according to the invention.

A block diagram of the preferred embodiment of transmitting system 200 is shown in FIG. 2. It includes a microprocessor 201, a clock 202, an oscillator 203, an amplifier 204, an antenna 205, a security circuit 206, a memory 207, a communications port 208, a DC power source 209, a charging connection 210, an oscillator control 211. Microprocessor 201 is connected to clock 202, oscillator control 211, amplifier 204, security circuit 206, memory 207, communications port 208, and DC power source 209. Antenna 205 is connected to amplifier 204. DC power source 209 is connected to microprocessor 201, clock 202, receiver 203, security circuit 206, memory 207, and charging connection 210. Security circuit 206 is preferably constructed from copper wire, but may be made from any electrically conductive material. All of the above listed components of transmitting system 200 are common items readily available at any electronics supply house.

The electromagnetic signal emitted by transmitting system 200 is produced by oscillator 203, amplified by amplifier 204, and transmitted via antenna 205, a specific frequency may be selected by manipulating oscillator 203 through oscillator control 211. For a predetermined interval occurring once per minute, microprocessor 201 directs power from DC power source 209 to oscillator 203 and amplifier 204, and a signal is transmitted. Microprocessor 201 also continuously monitors security circuit 206. In the event that a person attempts to remove transmitting system 200 from the limb, this circuit will be rendered inoperative, and microprocessor 201 will record the date and time that security circuit 206 failed.

Figure 8:
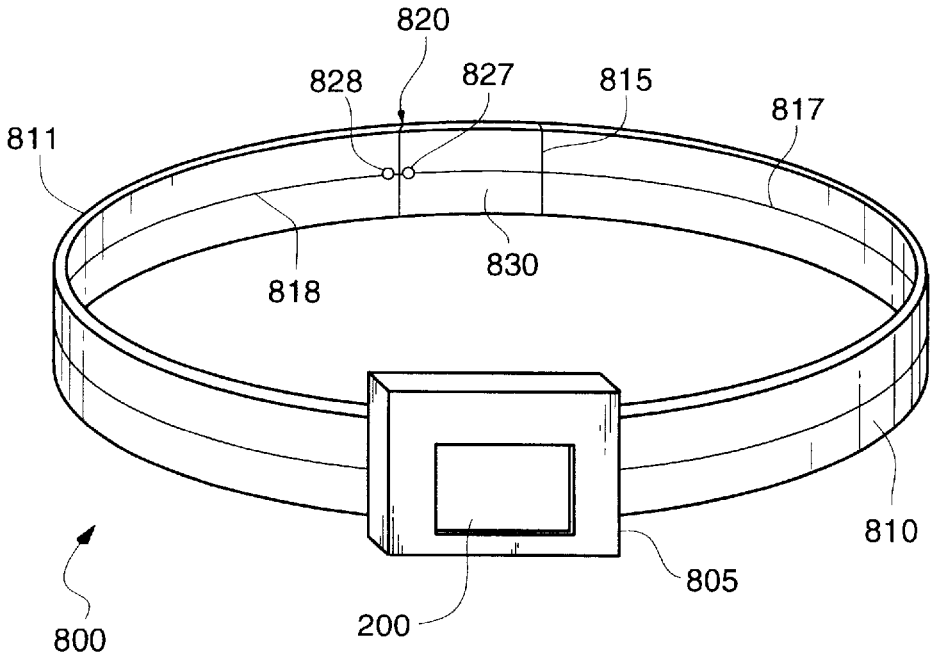
FIG. 8 illustrates the preferred embodiment of the bracelet that attaches transmitting system 200 to the limb of a person.

FIG. 8 illustrates the preferred embodiment of bracelet 800. Bracelet 800 attaches transmitting system 200 to the limb of a person. Bracelet 800 includes housing 805, attachment 810, attachment 811, hinge 815, connection 820, flange 830, conductive filament 817, conductive filament 818, electrode 827 and electrode 828. Preferably, housing 805, attachment 810 and attachment 811 are constructed of high strength plastic such ABS or polycarbonate, but a more flexible plastic such as polyethylene may be used. Preferably, conductive filament 817, conductive filament 818, electrode 827 and electrode 828 are constructed from copper, but any electrically conductive material may be used.

Housing 805 contains transmitting system 200. Attachment 810 and attachment 811 are curved to fit around a human limb, and are connected to housing 805. Attachment 810 is connected to flange 830 by hinge 815. Flange 830 connects to attachment 811 at connection 820. Conductive filament 817 is embedded in attachment 810 and flange 830. Conductive filament 817 is constructed of copper wire or a similar electrically conductive material. The first end of conductive filament is connected to security circuit 206 in transmitting system 200. The second end of conductive filament attaches to electrode 827. Attachment 811 contains conductive filament 818. The first end of conductive filament 818 is connected to security circuit 206 in transmitting system 200. The second end of conductive filament 818 is attached to electrode 828. Once bracelet 800 is placed around the limb of a person, flange 830 is closed and electrode 827 is brought into contact with electrode 828. This completes security circuit 206.

Figure 5:
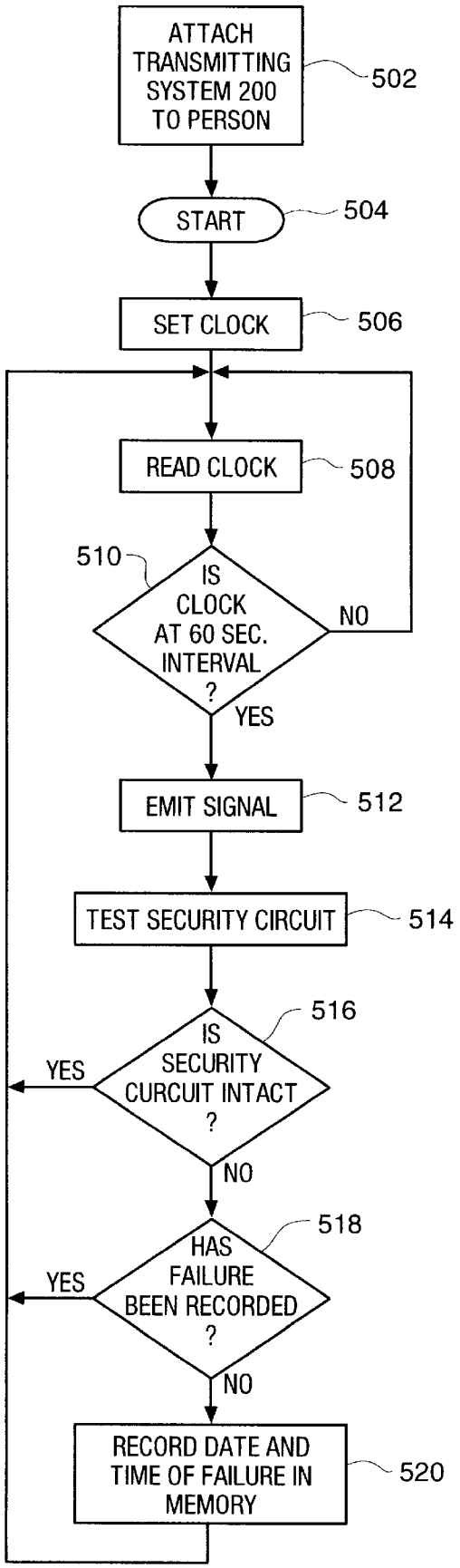
FIG. 5 illustrates the logical flow of control of the transmitting system according to the invention.

The logical flow of control of transmitting system 200 is shown in FIG. 5.

In step 502, Transmitting system 200 is secured by bracelet 800 to the limb of a person whose proximity to receiving device 400 is to be detected. In step 504, transmitting system 200 is started by attaching DC power source 209. In step 506 dock 202 is set to current date and time. Processing control continues to step 508, where microprocessor 201 reads clock 202. At step 510, microprocessor determines if clock 202 is at a 60 second interval. If not, processing returns to step 508. If dock 202 is at a 60 second interval, processing continues to step 512, where microprocessor 201 activates oscillator 203 and amplifier 204, and directs oscillator 203 to generate a signal at a preprogrammed frequency. The signal created by oscillator 203 is amplified by amplifier 204 and transmitted by antenna 205 for a predetermined interval, after which time microprocessor 201 disables oscillator 203 and amplifier 204. Processing continues to step 514, where microprocessor 201 tests security circuit 206 by sending an electrical current along security circuit 206. Processing continues to step 516, where if the electrical current is detected in security circuit 216, control is returned to step 508. If electrical current is not detected in security circuit 216, processing proceeds to step 518. In step 518 if the failure of security circuit 216 has been recorded in memory 207 control returns to step 508. If memory 207 does not contain a failure message, processing proceeds to step 520. In step 520 microprocessor 201 writes failure message to memory 207. Processing then returns to step 520.

Transmitting system 200 interfaces with other computers via communication port 208. Communication port 208 facilitates setting clock 202 and reading memory 207. Charging connection 210 facilitates testing and recharging DC power source 209.

A block diagram of the preferred embodiment of the monitoring system 300 is shown in FIG. 3. It includes a microprocessor 301, a clock 302, a receiver 303, a timer 304, an antenna 305, a security circuit 306, a memory 307, a communications port 308, a DC power source 309, a charging connection 310, and status table 311. Microprocessor 301 is connected to clock 302, receiver 303, timer 304, security circuit 306, memory 307, communications port 308, and DC power source 309. Memory 307 includes memory locations containing status table 311 and timer 304. Status table 311 is preferably implemented in memory using a stack data structure. Antenna 305 is connected to receiver 303. DC power source 309 is connected to microprocessor 301, clock 302, receiver 303, security circuit 306, memory 307, and charging connection 310. All the above-listed components of receiving system 300 are common items readily available at any electronics supply house.

The function of monitoring system 300 is to verify transmission of signals by transmitting system 200 at regular intervals. Monitoring system 300 is attached to a limb other than that bearing transmitting system 200 to prevent a person from covering both devices with a single piece of RF absorbent or reflective material, thus preventing the reception of transmitted signals by any device other than monitoring system 300. Monitoring system 300 continuously monitors the frequency over which a signal is transmitted by transmitting system 200. Timer 304 is a memory location in memory 307 that keeps a running count of seconds that resets each minute. If a period of one minute passes without reception of a signal and a reception failure message has not been recorded, the date and time of reception failure is recorded at the top of status table 311, a stack implemented in memory 307. No further entry is made until a signal is received, at which time the date and time of reception is recorded on status table 311. Microprocessor 301 also continuously monitors security circuit 306. In the event that a person attempts to remove monitoring system 300 from the limb, this circuit will be rendered inoperative, and microprocessor 301 will record the date and time that security circuit 306 failed.

Figure 9:
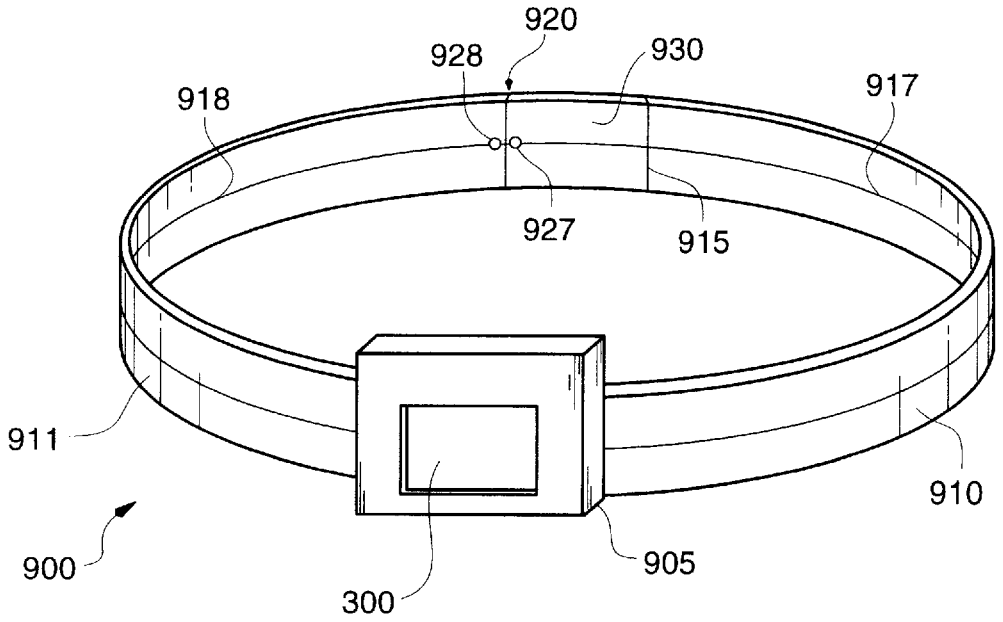
FIG. 9 illustrates the preferred embodiment of the bracelet that attaches monitoring system 300 to the limb of a person.

FIG. 9 illustrates the preferred embodiment of bracelet 900. Bracelet 900 attaches monitoring system 300 to the limb of a person. Bracelet 900 includes housing 905, attachment 910, attachment 911, hinge 915, connection 920, flange 930, conductive filament 917, conductive filament 918, electrode 927 and conductive filament 928. Preferably, housing 905, attachment 910 and attachment 911 are constructed of high strength plastic such ABS or polycarbonate, but a more flexible plastic such as polyethylene may be used. Preferably, conductive filament 917, conductive filament 918, electrode 927 and electrode 928 are constructed from copper, but any electrically conductive material may be used.

Housing 905 contains monitoring system 300. Attachment 910 and attachment 911 are curved to fit around a human limb, and are connected to housing 905. Attachment 910 is connected to flange 930 by hinge 915. Flange 915 connects to attachment 911 at connection 920. Conductive filament 917 is embedded in attachment 910 and flange 930. Conductive filament 917 is constructed of copper wire or a similar electrically conductive material. The first end of conductive filament is connected to security circuit 306 in monitoring system 300. The second end of conductive filament attaches to electrode 927. Attachment 911 contains conductive filament 918. Conductive filament 918 is constructed of copper wire or a similar electrically conductive material. The first end of conductive filament 918 is connected to security circuit 306 in monitoring system 300. The second end of conductive filament 918 is attached to electrode 928. Once bracelet 900 is placed around the limb of a person, flange 930 is closed and electrode 927 is brought into contact with electrode 928. This completes security circuit 306.

Figure 6:
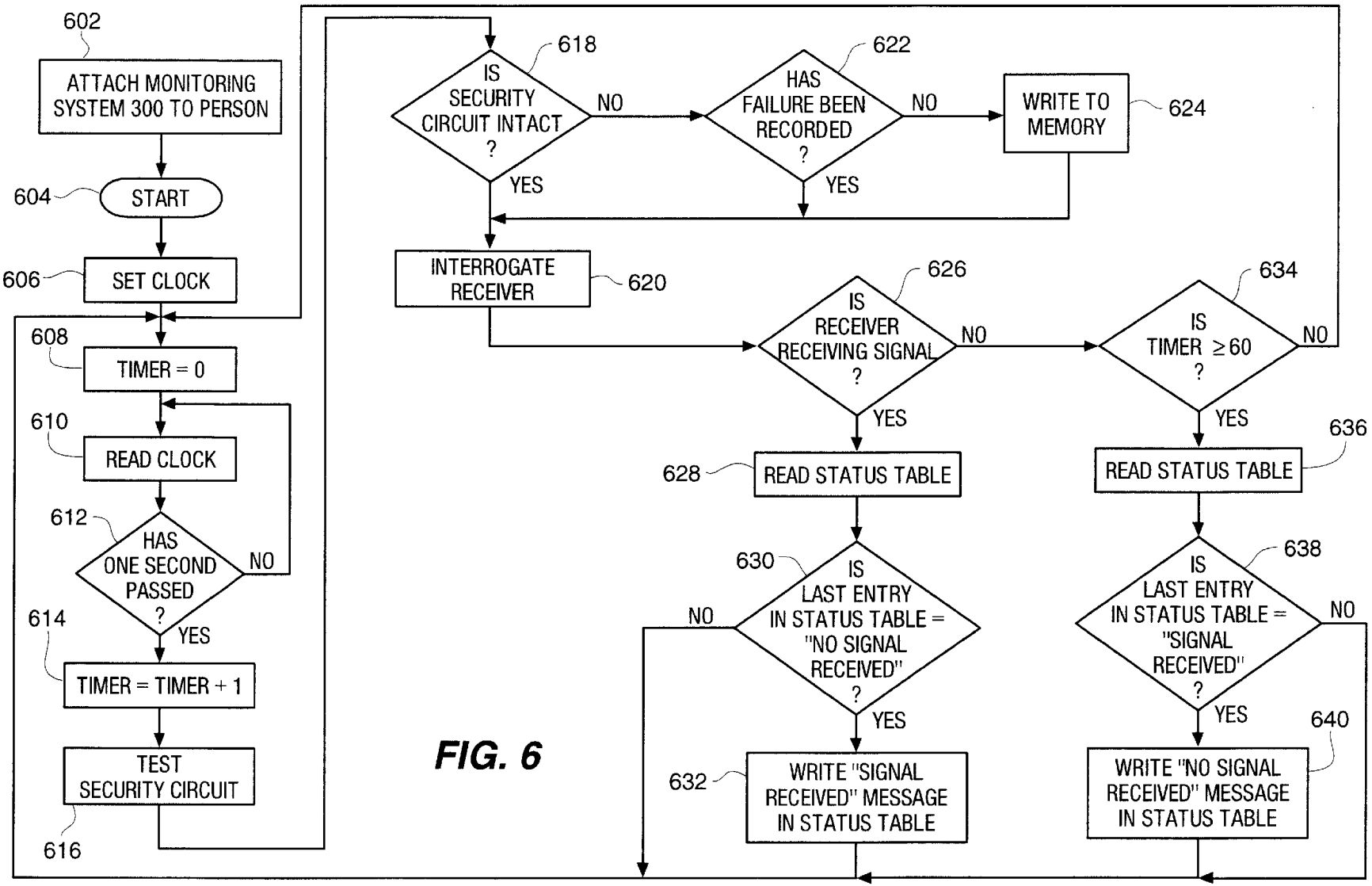
FIG. 6 illustrates the logical flow of control of the monitoring system according to the invention.

The logical flow of control of monitoring system 300 is shown in FIG. 6.

In step 602 monitoring system 300 is secured by attaching means 316 to the limb of a person whose proximity to receiving device 400 is to be detected. In step 604 monitoring system 300 is started by attaching DC power source 309.

In step 606 clock 302 is set to current date and time. In step 608 timer 304 is assigned a zero value. Processing continues to step 610, where microprocessor 301 reads clock 302. Processing continues to step 612, where microprocessor 301 determines if one second has passed. If one second has not passed, processing returns to step 610. If one second has passed, processing continues to step 614, where the value of timer 304 is incremented by 1. Processing continues to step 616. At step 616 microprocessor 301 tests security circuit 306 by sending an electrical current along security circuit 306. Processing continues to step 618. At step 618, if the electrical current is detected in security circuit 316, processing continues to step 620. If electrical current is not detected in security circuit 306, processing continues to step 622. At step 622, microprocessor 301 determines if the failure of security circuit 316 has been recorded. If the failure of security circuit 316 has been recorded, processing continues to step 620. If the failure of security circuit 316 has not been recorded, processing continues to step 624. At step 624, microprocessor 301 writes a message in memory 307 indicating that security circuit 316 has failed, along with date and time the failure was detected. Processing then continues to step 620. At step 620, microprocessor 301 interrogates receiver 303. Processing then continues to step 626. At step 626 microprocessor 301 determines if receiver 303 is receiving a signal. If receiver 303 is receiving a signal processing continues to step 628. At step 628 microprocessor 301 reads the last entry in status table 311. Processing then continues to step 630. At step 630, the last entry in status table 311 is evaluated. If the last entry in status table 311 does not indicate "no signal received" processing returns to step 608. If the last entry in status table 311 indicates "no message received" processing continues to step 632. At step 632 microprocessor 301 enters into status table 311 a message indicating "signal received" together with date and time. Processing then returns to 608.

If, at step 626, microprocessor 301 determines that receiver 303 is not receiving a signal processing continues to step 634. At step 634, microprocessor 301 evaluates the value stored in timer 304. If the value stored in timer 304 is less than 60 processing returns to step 608. If the value stored in timer 304 is 60 or greater processing continues to step 636. At step 636 microprocessor 301 reads status table 311 and processing continues to step 638. At step 638 the last entry in status table 638 is evaluated. If the last entry in status table 311 does not indicate "signal received" control returns to step 608. If the last entry in status table 311 indicates "signal received" processing continues to step 640. At step 640 microprocessor 301 enters into status table 311 a message indicating "no signal received" together with date and time. Processing then returns to step 608.

Monitoring system 300 interfaces with other computers via communication port 308. Communication port 308 facilitates setting clock 302 and reading memory 307. Charging connection 310 facilitates testing and recharging DC power source 309.

Figure 4:
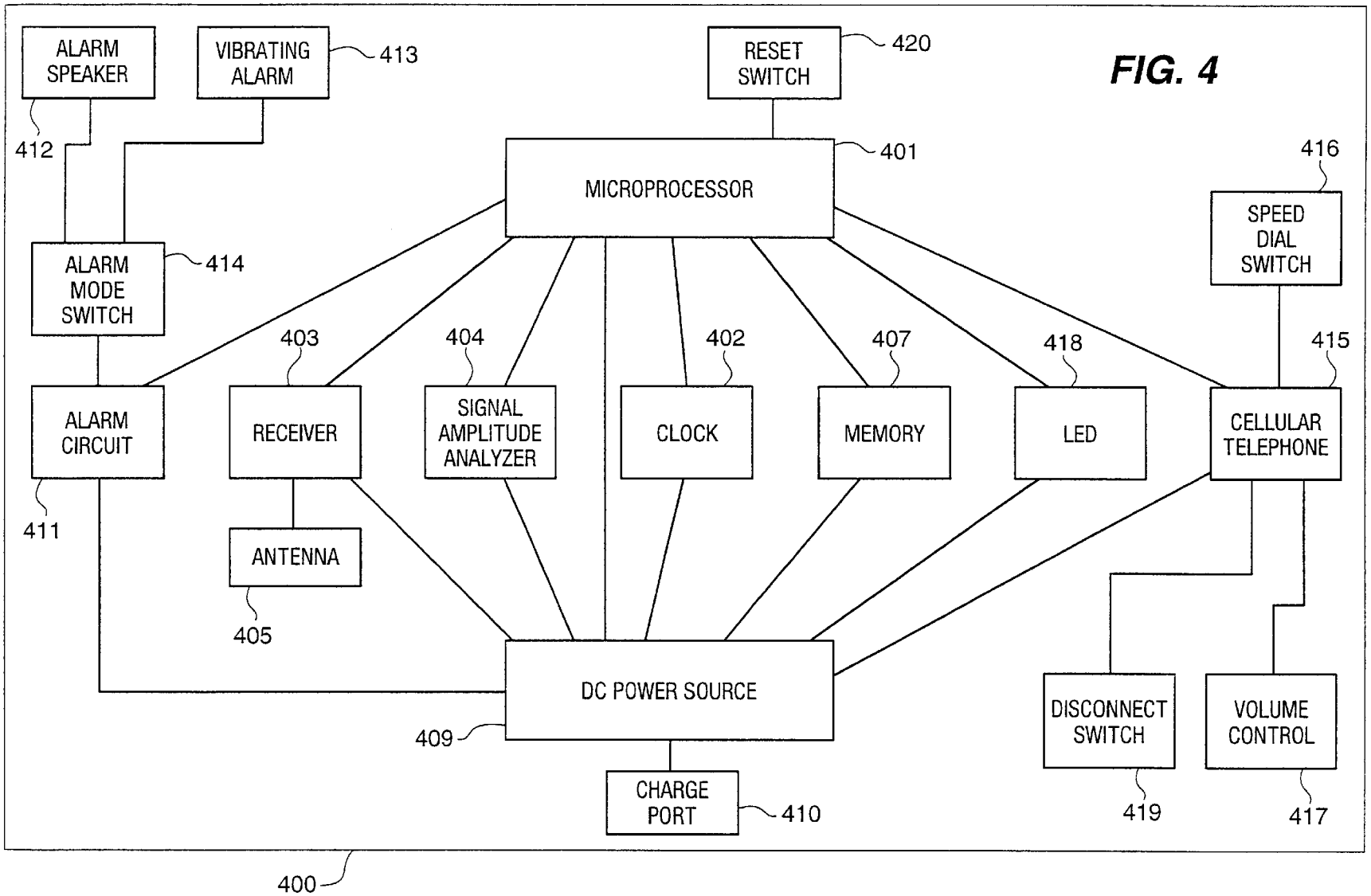
FIG. 4 shows a block diagram of the receiving system according to the Invention.

A block diagram of the preferred embodiment of receiving system 400 is shown in FIG. 4. It includes a microprocessor 401, a clock 402, a receiver 403, a signal strength detector 404, an antenna 405, a memory 407, a DC power source 409, a charging connection 410, an alarm circuit 411, an alarm speaker 412, a vibrating alarm 413, alarm mode switch 414, a cellular telephone 415, a speed dialing switch 416, a volume control 417, an LED display 418, a disconnect switch 419, and reset switch 420. Microprocessor 401 is connected to clock 402, receiver 403, signal strength detector 404, memory 407, DC power source 409, alarm circuit 411, cellular telephone 415, speed dialing button 416, volume control 417, LED display 418, disconnect switch 419, and reset button 420. Antenna 405 is connected to receiver 403. DC power source 409 is connected to microprocessor 401, clock 402, receiver 403, signal strength detector 404, memory 407, charging connection 410, alarm circuit 411, cellular telephone 415, and LED display 418. Signal strength detector 404 preferably incorporates automatic gain control (AGC) into an integrated circuit, as in Hawthorne (U.S. Pat. No. 4,785,291). The proximity detector in Hawthorne uses AGC to determine signal strength of a transmitter and sounds an alarm when the transmitter is beyond a threshold range of the receiver and proximity detector. The claimed invention incorporates the circuitry disclosed in Hawthorne into signal strength detector 404 to determine when transmitting system 200 is within a predetermined threshold of receiver 403. All of the above listed components of receiving system 400 are common items readily available from any electronics supply house.

Receiving system 400 monitors signals transmitted by transmitting system 200 and issues a warning if the strength of the signal transmitted by transmitting system 200 is above a predetermined threshold level. At the time signal strength exceeds the threshold level, microprocessor 401 activates alarm circuit 411. Depending on the position of alarm mode switch 414, either alarm speaker 412 or vibrating alarm 413 will be activated. Also at the time the received signal strength exceeds threshold level, microprocessor 401 activates cellular telephone 415, which allows a user to contact police or emergency personnel at a pre-programmed telephone number. DC power source 409 allows charging to occur while still supplying electrical power to receiving system 400.

FIG. 10 shows the preferred embodiment of receiving system 400. Receiving system 400 is contained in the housing of cellular telephone 415. Alarm mode switch 414 controls the type of alarm issued if a signal of sufficient strength is detected. In the default position, alarm mode switch 414 activates alarm speaker 412. If alarm mode switch 414 (labeled "silent alarm") is activated, alarm speaker 412 deactivated and vibrating alarm 413 is activated. Speed dial switch 416 is also activated upon detection of sufficient signal strength. Upon user activation, speed dial switch 416 (labeled "911") will dial a pre-programmed telephone number, allowing cellular telephone 415 to establish connection. Once speed dial switch 416 is activated, alarm speaker 412 is muted and vibrating alarm 413 is terminated. LED display 418 flashes an alarm message accompanied by the time and date the signal was received. LED display 418 displays the telephone number being dialed by cellular telephone 415. Disconnect switch 419 terminates telephone connection. Volume control 417 controls the volume of cellular telephone speaker 901. Reset switch 420 deactivates alarm circuit 411 and cellular telephone 415 until next signal of sufficient strength is detected. Charge port 410 provides a charging connection to DC power source 409.

Figure 7:
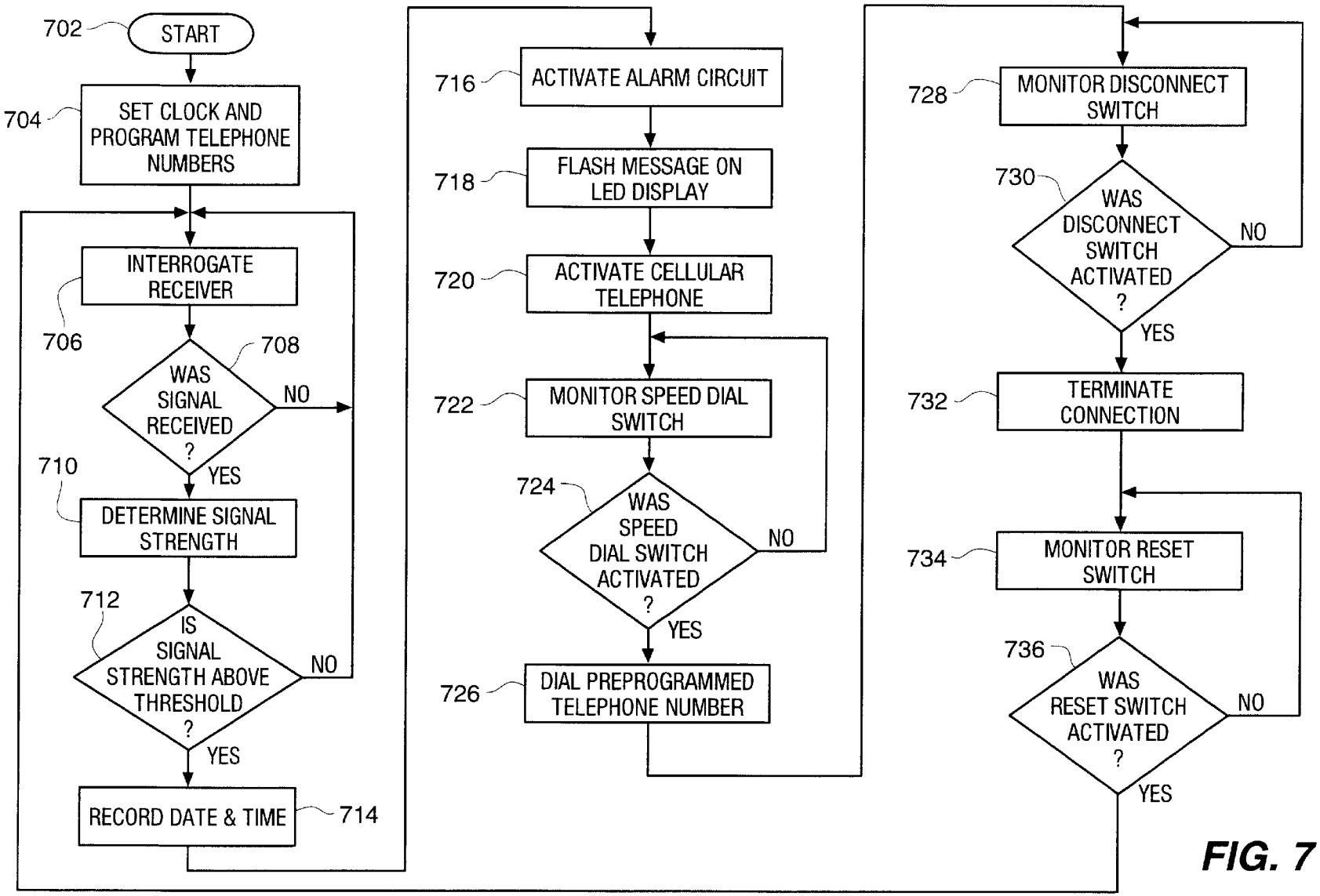
FIG. 7 illustrates the logical flow of control of the receiving system according to the invention.

The logical flow of control of receiving system 400 is shown in FIG. 7.

In step 702 receiving system 400 is started by attaching DC power source 409. Processing continues to step 704. At step 704 clock 402 is set to current date and time and telephone numbers for local police or 911 are programmed into memory 407. Processing continues to step 706. At step 706 microprocessor 401 interrogates receiver 403. Processing continues to step 708. At step 708 microprocessor 401 evaluates the behavior of receiver 403. If receiver 403 has not detected a signal emitted by transmitting system 200, processing returns to step 706. If receiver 403 has detected a signal emitted by transmitting system 200, processing continues to step 710. At step 710 microprocessor 401 activates signal strength detector 404 and directs signal strength detector 404 to determine the amplitude of signal received by receiver 403. Processing continues to step 712. At step 712 microprocessor 401 evaluates the amplitude of the signal received by receiver 403 If microprocessor 401 determines that the signal analyzed by signal strength detector 404 in Step 3 is below a predetermined amplitude control returns to step 706. If microprocessor 401 determines that the signal analyzed by signal strength detector 404 is above a predetermined amplitude level processing continues to step 714. At step 714 microprocessor 401 reads clock 402 and records date and time into memory 407. Processing continues to step 716. At step 716 microprocessor 401 activates alarm circuit 411. Alarm mode switch 414 directs alarm circuit 411 to activate alarm speaker 412 or vibrating alarm 413. Processing continues to step 718. At step 718 microprocessor 401 directs LED display 418 to flash alarm message. Processing continues to step 720. At step 720 microprocessor 401 activates cellular telephone 415. Processing continues to step 722. At step 722 microprocessor 401 interrogates speed dial button 416. Processing continues to step 724. At step 724 microprocessor 401 evaluates the position of speed dial button 416. If speed dial button 416 is not activated processing returns to step 722. If speed dial button 716 is activated processing continues to step 726. At step 726 microprocessor 401 deactivates alarm circuit 411 and directs cellular telephone 415 to dial telephone number stored in memory 407 and establish telephone connection. Processing continues to step 728. At step 728 microprocessor 401 interrogates disconnect switch 419. Processing continues to step 730. At step 730 microprocessor evaluates the position of disconnect switch 419. If disconnect switch 419 is not activated processing returns to step 728. If disconnect switch 419 is activated processing continues to step 732. At step 732 microprocessor 401 terminates the telephone connection and deactivates cellular telephone 415. Processing continues to step 734. At step 734 microprocessor 401 interrogates monitor reset switch 420. Processing continues to step 736. At step 736 microprocessor evaluates the position of reset switch 420. If reset switch 420 was activated control returns to step 706. If reset switch 420 was not activated control returns to step 734.

Volume control 417 controls volume of alarm speaker 412 and cellular telephone 415. Charge connection 410 allows DC power source 409 to be charged. By pressing reset switch 420, disconnect switch 419 and alarm mode switch 414 in sequence a user can direct LED display 418 to indicate time and date alarm was received.

The claimed invention solves the problem of providing a secure, mobile perimeter by issuing an alarm when a perimeter has been violated. While the claimed invention focuses primarily on maintaining a distance between two individuals, it also lends itself to the application of handling hazardous materials by providing a means for determining when a person has come too close to the hazardous material and providing a communications link that can summon emergency personnel. Defense plants and electronics assembly plants can attach transmitting system 200 to the limbs of employees and place receiving system 300 in a protected area to protect secure projects or sterile environments. By securing transmitting system 200 to the limb of a prisoner or mental patient being transported receiving system 300 can be used to determine his or her proximity and summon assistance in the event of an escape.

We claim:

1. A personal warning system comprising:

a mobile transmitting device for transmitting electromagnetic signals;

a mobile transmission monitoring device for verifying transmission of signals by said transmitting device; and a mobile receiving device comprising:

a receiver for receiving said electromagnetic signals transmitted by said transmitting device;

a proximity device for providing a signal indicative of the proximity of said transmitting device, said proximity device comprising an electromagnetic signal amplitude monitor;

an alarm, communicating with said proximity device, for providing a warning of the proximity of said transmitting device; and a reset switch to terminate the alarm until proximity of said mobile transmitting device is detected again.

2. A personal warning system as in claim 1 wherein said mobile receiving device further comprises a cellular telephone for communicating with police or emergency personnel.

3. A personal warning system as in claim 1 wherein said mobile receiving device further comprises a switch that automatically activates a cellular telephone upon receipt of said signal from said proximity device.

4. A personal warning system as in claim 1 wherein said mobile receiving device further comprises an audible alarm or a vibrating alarm.

5. A personal warning system as in claim 4 wherein said mobile receiving device further comprises a switch to select said audible alarm or said vibrating alarm.

6. A personal warning system as in claim 1 wherein said mobile receiving device further comprises a battery charger for charging the battery of the receiving device while said mobile receiving device continues to monitor said electromagnetic signals transmitted by said transmitting device.

7. A personal warning system as in claim 1 further comprising a bracelet to attach a selection from the group consisting of said mobile transmitting device and said mobile transmission monitoring device to the limb of a human being.

8. A personal warning system as in claim 7 wherein said bracelet further comprises:

a wire embedded in said bracelet that attaches said selection to said limb;

electrical connections for generating an electrical current along said wire; and a recorder for recording the date and time said wire is severed.

9. A personal warning system comprising:

a mobile transmitting device for transmitting electromagnetic signals;

a mobile transmission monitoring device for verifying transmission of signals by said transmitting device; and a mobile receiving device comprising:

a receiver for receiving said electromagnetic signals transmitted by said mobile transmitting device;

a proximity device for providing a signal indicative of the proximity of said mobile transmitting device; and a cellular telephone for communicating with police or emergency personnel; said cellular telephone including a speaker volume control.

10. A personal warning system as in claim 9 further comprising an automatic dialer for dialing a preprogrammed telephone number.

11. A personal warning system as in claim 9 further comprising a bracelet to attach a selection from the group consisting of said mobile transmitting device and said mobile transmission monitoring device to the limb of a human being.

12. A personal warning system as in claim 11 wherein said bracelet further comprises:

a wire embedded in said bracelet that attaches said mobile transmitting device to said limb;

electrical connections for generating an electrical current along said wire; and a recorder for recording the date and time said wire is broken or severed.

13. A mobile monitoring system comprising:

a mobile transmitting device to transmit an electormagnetic signal at a set frequency and over periodic intervals;

a bracelet to attach said mobile transmitting device to the limb of a human being;

a receiver for receiving said electromagnetic signals transmitted by said transmitting device;

a proximity device for providing a signal indicative of the proximity of said transmitting device;

an alarm, communicating with said proximity device, for providing a warning of the proximity of said transmitting device;

a mobile receiving device for receiving signals transmitted by said mobile transmitting device;

a bracelet to attach said mobile receiving device to the limb of a human being; and a recorder for recording the data and time said mobile receiving device does not receive said electromagnetic signal transmitted by said mobile transmitting device.

14. A monitoring system in claim 13 wherein said mobile transmitting device further comprises:

a verification system comprising:

a wire embedded in said bracelet that attaches said mobile transmitting device to said limb;

electrical connections for generating an electrical current along said wire; and a recorder for recording the date and time said wire is broken or severed.

15. A mobile monitoring system as in claim 13 wherein said receiving device further comprises:

a verification system comprising:

a wire embedded in said bracelet that attaches said receiver to said limb;

electrical connections for generating an electrical current along said wire; and a recorder for recording the date and time said wire is broken or severed.

* * * * *